US008598810B2

(12) United States Patent
Lu

(10) Patent No.: US 8,598,810 B2
(45) Date of Patent: Dec. 3, 2013

(54) CONSTANT CURRENT DRIVING CIRCUIT OF LIGHT EMITTING DIODE AND LIGHTING APPARATUS

(75) Inventor: Yung-Chen Lu, Hsinchu County (TW)

(73) Assignee: Excelliance MOS Corporation, Hsinchu County (TW)

( * ) Notice: Subject to any disclaimer, the term of this patent is extended or adjusted under 35 U.S.C. 154(b) by 258 days.

(21) Appl. No.: 13/101,154

(22) Filed: May 5, 2011

(65) Prior Publication Data

US 2012/0280630 A1 Nov. 8, 2012

(51) Int. Cl.
*H05B 37/02* (2006.01)

(52) U.S. Cl.
USPC ..... 315/307; 315/297

(58) Field of Classification Search
USPC ..... 315/291, 294, 297, 307
See application file for complete search history.

(56) References Cited

U.S. PATENT DOCUMENTS

| | | | | |
|---|---|---|---|---|
| 8,093,826 | B1 * | 1/2012 | Eagar et al. | 315/291 |
| 8,482,219 | B2 * | 7/2013 | Kuo et al. | 315/291 |
| 8,508,150 | B2 * | 8/2013 | Kuo et al. | 315/291 |
| 2007/0229001 | A1 * | 10/2007 | McIntosh et al. | 315/307 |
| 2008/0316781 | A1 * | 12/2008 | Liu | 363/80 |
| 2009/0273292 | A1 * | 11/2009 | Zimmermann | 315/209 R |
| 2009/0315473 | A1 * | 12/2009 | Tsai et al. | 315/291 |
| 2010/0207536 | A1 * | 8/2010 | Burdalski et al. | 315/224 |
| 2011/0109249 | A1 * | 5/2011 | Liu et al. | 315/307 |
| 2011/0115770 | A1 * | 5/2011 | Seo et al. | 345/211 |

FOREIGN PATENT DOCUMENTS

| | | |
|---|---|---|
| JP | 2008235530 | 10/2008 |
| JP | 2010177059 | 8/2010 |
| KR | 1020080002852 | 1/2008 |

OTHER PUBLICATIONS

"Office Action of Korea Counterpart Application", issued on Aug. 24, 2012, with English translation thereof, p. 1-p. 8.

* cited by examiner

*Primary Examiner* — Jason M Crawford
(74) *Attorney, Agent, or Firm* — Jianq Chyun IP Office

(57) ABSTRACT

A constant current driving circuit of a light emitting diode (LED) including a control unit, a buck converter, and a compensation unit is provided. The control unit has an input terminal and an output terminal, and outputs a control signal through the output terminal. The buck converter is coupled to an input power, and is coupled between the output terminal of the control unit and an LED string. The compensation unit is coupled between the LED string and the input terminal of the control unit. The control unit receives a compensation signal of the compensation unit through the input terminal. Besides, a lighting apparatus is also provided.

18 Claims, 4 Drawing Sheets

CONSTANT CURRENT DRIVING CIRCUIT OF LIGHT EMITTING DIODE AND LIGHTING APPARATUS

BACKGROUND OF THE INVENTION

1. Field of the Invention

The invention relates to a driving circuit and a lighting apparatus. Particularly, the invention relates to a constant current driving circuit of light emitting diode (LED) and a lighting apparatus.

2. Description of Related Art

Since a light emitting diode (LED) has a small volume, low power consumption and high durability, products using the LEDs as light sources become popular as processing techniques gradually become mature. Since a tiny change of bias may cause a significant change of an operating current within an operation range of the LED, the LED has to be driven by a constant current; otherwise, once the current exceeds a rated value, the LED is probably damaged.

According to a conventional method for driving the LED, a control signal output by a control chip is generally used to turn on/off a switch coupled to the LED. Further, when the control chip detects that a current flowing through the LED is excessively high, the switch is turned off by the output signal, and the current flowing through the LED is gradually decreased along with energy dissipation. However, since the signal transmission takes time, which causes a phenomenon of propagation delay, when the control chip detects an abnormal current, the control chip cannot immediately turns off the switch, so that only after a period of delay time, the abnormal current flowing through the LED can be controlled, and once an operating frequency of the LED is varied, the effect of driving the LED by the constant current cannot be achieved, which may cause damage of the LED after long time utilization.

Therefore, it is a development trend to provide a constant current driving technique of the LED.

SUMMARY OF THE INVENTION

The invention is directed to a constant driving circuit of light emitting diode (LED), which is capable of maintaining a current flowing through the LED at a substantial fixed value.

The invention is directed to a lighting apparatus, which is capable of providing a LED light source with stable brightness.

The invention provides a constant current driving circuit of light emitting diode (LED), which includes a control unit, a buck converter, and a compensation unit. The control unit has a first input terminal and a first output terminal, and outputs a control signal through the first output terminal. The buck converter is coupled to an input power, and is coupled between the first output terminal of the control unit and an LED string. The compensation unit is coupled between the LED string and the first input terminal of the control unit. The control unit receives a compensation signal of the compensation unit through the first input terminal.

In an embodiment of the invention, the LED string is coupled between a first end and a second end of the buck converter.

In an embodiment of the invention, the compensation unit has a second input terminal and a second output terminal. The second input terminal is coupled to the second end of the buck converter, and the second output terminal is coupled to the first input terminal of the control unit.

In an embodiment of the invention, the compensation unit includes a compensation resistor and a first resistor. The compensation resistor is coupled between the LED string and the first input terminal of the control unit. The first resistor is coupled between the compensation resistor and ground.

In an embodiment of the invention, a resistance of the compensation resistor is from 10 ohms to half a million ohms.

In an embodiment of the invention, the compensation unit further includes a filter resistor coupled between the compensation resistor and the first resistor.

In an embodiment of the invention, a resistance of the compensation resistor is from 10,000 ohms to 90 million ohms.

In an embodiment of the invention, the compensation unit further includes a filter capacitor coupled between the filter resistor and the ground.

In an embodiment of the invention, the constant current driving circuit of the LED further includes a capacitor coupled to two ends of the LED string.

In an embodiment of the invention, the buck converter comprises a diode, an inductor and a switch. The diode is coupled to the input power and the LED string. The inductor is coupled between the diode and the LED string, where the LED string, the inductor and the diode form a loop. One end of the switch is coupled to the diode and the inductor, and another end thereof is coupled to the compensation unit.

In an embodiment of the invention, the control unit comprises a clock generator, an SR flip-flop and a comparator. The SR flip-flop is coupled between the clock generator and the buck converter. The SR flip-flop has a set terminal and a reset terminal, and receives a clock signal through the set terminal. The comparator has a positive terminal, a negative terminal and a third output terminal. The positive terminal is coupled to the compensation unit, the negative terminal receives a reference voltage, and the third output terminal is coupled to the reset terminal of the SR flip-flop.

The invention further provides a lighting apparatus including an LED string and a constant current driving circuit. The constant current driving circuit is coupled to the LED string and includes the aforementioned control unit, the buck converter and the compensation unit.

According to the above descriptions, in the invention, the compensation unit is coupled between the LED string and the first input terminal of the control unit to provide a compensation signal varied along with the input power and the cross-voltage of the LED, so that the current flowing through the LED is substantially maintained at a fixed value without being influenced by variation of the cross-voltage of the LED or the delay time and variation of the operating frequency, so as to provide an LED light source with a stable brightness.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

First Embodiment

Figure 1:
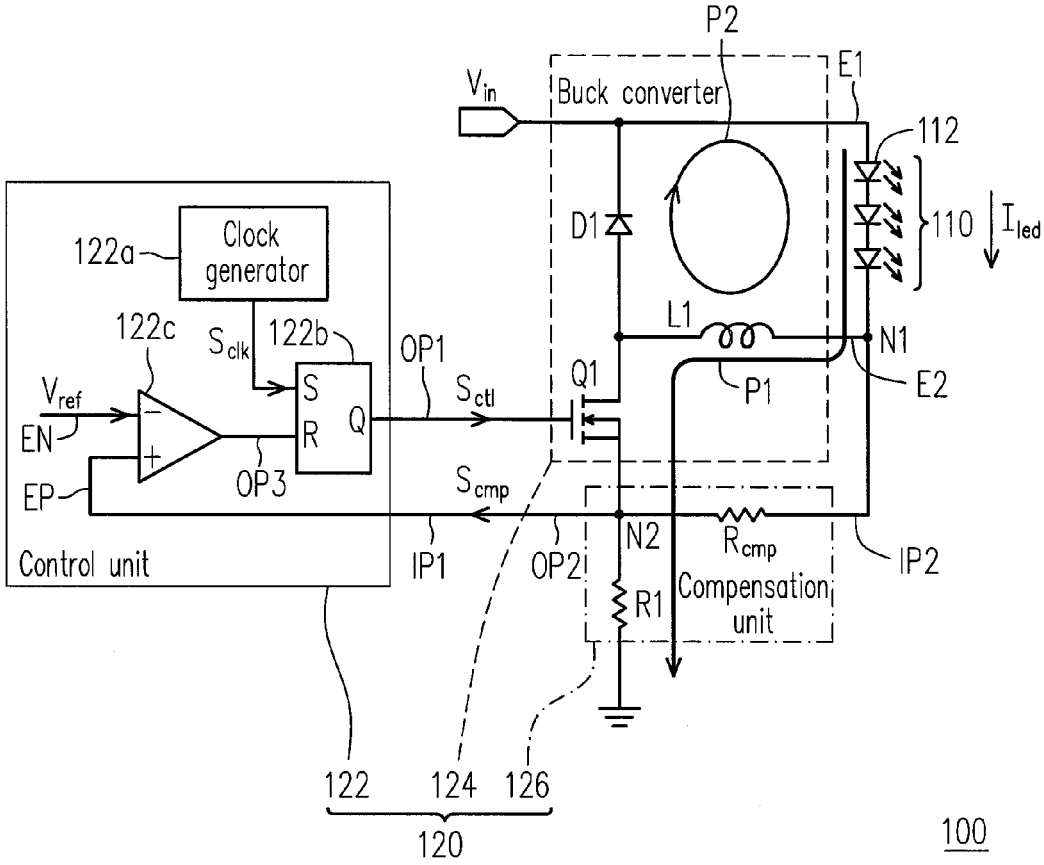
FIG. 1 is a schematic diagram of a lighting apparatus according to the first embodiment of the invention.

FIG. 1 is a schematic diagram of a lighting apparatus according to the first embodiment of the invention. The lighting apparatus 100 includes a light emitting diode (LED) string 110 and a constant current driving circuit 120. The LED string 110 is, for example, composed of a plurality of LEDs 112 connected in series (three LEDs are schematically illustrated in FIG. 1). The constant current driving circuit 120 is coupled to the LED string 110, and is adapted to drive the LED string 110, where the constant current driving circuit 120 of the present embodiment can substantially maintain a current flowing through the LED string 110 at a fixed value in case that an operating frequency of the LED string 110 is varied.

As shown in FIG. 1, the constant current driving circuit 120 includes a control unit 122, a buck converter 124, and a compensation unit 126. The control unit 122 has an input terminal IP1 and an output terminal OP1, and outputs a control signal $S_{ctl}$ through the output terminal OP1. The buck converter 124 is coupled to an input power $V_{in}$, and is coupled between the output terminal OP1 of the control unit 122 and the LED string 110. Moreover, the compensation unit 126 is coupled between the LED string 110 and the input terminal IP1 of the control unit 122. The control unit 122 receives a compensation signal $S_{cmp}$ of the compensation unit 126 through the input terminal IP1. Besides, the LED string 110 is coupled between a first end E1 and a second end E2 of the buck converter 124. The compensation unit 126 has an input terminal IP2 and an output terminal OP2, where the input terminal IP2 is coupled to the second end E2 of the buck converter 124, and the output terminal OP2 is coupled to the input terminal IP1 of the control unit 122.

In detail, the buck converter 124 includes a diode D1, an inductor L1 and a switch Q1. As shown in FIG. 1, the diode D1 is coupled to the input power $V_{in}$ and the LED string 110. The inductor L1 is coupled between the diode D1 and the LED string 110, where the LED string 10, the inductor L1 and the diode D1 form a loop. One end of the switch Q1 is coupled to the diode D1 and the inductor L1, and another end thereof is coupled to the compensation unit 126.

On the other hand, the control unit 122 comprises a clock generator 122*a*, an SR flip-flop 122*b* and a comparator 122*c*. The SR flip-flop 122*b* is coupled between the clock generator 122*a* and the buck converter 124. The SR flip-flop 122*b* has a set terminal S, a reset terminal R and an output terminal Q. The SR flip-flop 122*b* receives a clock signal $S_{clk}$ through the set terminal S, and outputs the control signal $S_{ctl}$ through the output terminal Q. The comparator 122*c* has a positive terminal EP, a negative terminal EN and an output terminal OP3. The positive terminal EP is coupled to the compensation unit 126 to receive the compensation signal $S_{cmp}$, the negative terminal EN receives a reference voltage $V_{ref}$, and the output terminal OP3 is coupled to the reset terminal R of the SR flip-flop 122*b*. In the present embodiment, the control unit 122 is, for example, a control chip, and the control chip includes the aforementioned various devices. Besides, the compensation unit 126 includes a compensation resistor $R_{cmp}$ and a resistor R1. The compensation resistor $R_{cmp}$ is coupled between the LED string 110 and the input terminal IP1 of the control unit 122, and a voltage of a node N1 is a difference of the input power $V_{in}$ and a cross-voltage $V_{led}$ of the LED string 110 (i.e. $(V_{in}-V_{led})$). Moreover, the resistor R1 is coupled between the compensation resistor $R_{cmp}$ and ground.

Figure 2:
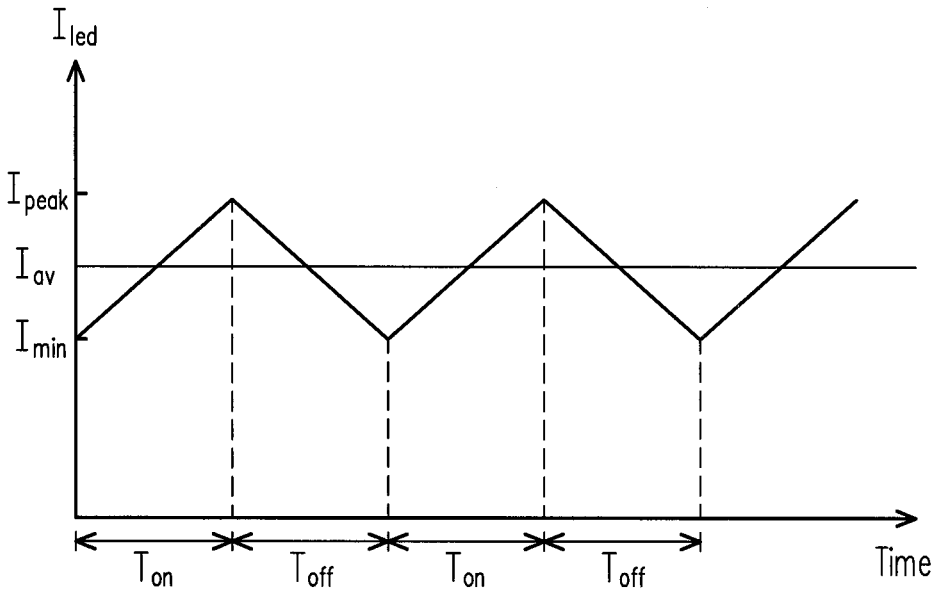
FIG. 2 is a schematic diagram of a current of a light emitting diode (LED) string of FIG. 1 varied along with time.

FIG. 2 is a schematic diagram of a current $I_{led}$ of the LED string 110 of FIG. 1 varied along with time. Referring to FIG. 1 and FIG. 2, in detail, the clock generator 122*a* of FIG. 1 provides the clock signal $S_{clk}$ to the set terminal S of the SR flip-flop 122*b* to trigger the set terminal S of the SR flip-flop 122*b* at each clock pulse, so as to turn on the switch Q1 of the buck converter 124. When the switch Q1 is turned on during a period $T_{on}$ of FIG. 2, the current $I_{led}$ flowing through the LED string 110 is transmitted along a path P1 shown in FIG. 1, which sequentially passes through the inductor L1 and the switch Q1 to the ground, where the current $I_{led}$ flowing through the LED string 110 and the inductor L1 is gradually increased as time increases (shown in FIG. 2), so that a cross-voltage of the resistor R1 is accordingly increased. When the current $I_{led}$ flowing through the LED string 110 is increased to a current peak $I_{peak}$ to cause the cross-voltage (i.e. the compensation signal $S_{cmp}$) of the resistor R1 to be higher than the reference voltage $V_{ref}$ (for example, 1V), the comparator 122*c* triggers the reset terminal R of the SR flip-flop 122*b* to turn off the switch Q1 of the buck converter 124. Then, when the switch Q1 is turned off during a period $T_{off}$, the current $I_{led}$ of the LED string 110 is cycled in the loop formed by the LED string 110, the inductor L1 and the diode D1 along a path P2, and the current $I_{led}$ is gradually decreased to $I_{min}$ along with energy dissipation of the LED string 110 until a next clock pulse is generated. Therefore, the current $I_{led}$ of the LED string 110 presents a periodic sawtooth waveform, which is approximately a stable current average $I_{av}$.

It should be noticed that since the current $I_{led}$ flowing through the inductor L1 during the period $T_{off}$ can be represented as $I_{L_off}=V_{led}\times T_{off}/L$, and according to FIG. 2, it is know that $I_{av}=I_{peak}-(I_{L_off}/2)$, so that the average of the current $I_{led}$ can be represented as $I_{av}=I_{peak}-(V_{led}\times T_{off}/2\ L)$. Therefore, according to the above equation, it is known that the average $I_{av}$ of the current $I_{led}$ flowing through the LED string 110 can be maintained at a fixed value by adjusting the current peak $I_{peak}$ and the period $T_{off}$, so as to achieve an effect of constant current control. Moreover, in the present embodiment, it is assumed that the period $T_{off}$ is fixed, to achieve the effect of constant current control, the current peak $I_{peak}$ has to be maintained at a fixed value, which is described in detail below.

Figures 3A, 3B, 3C:
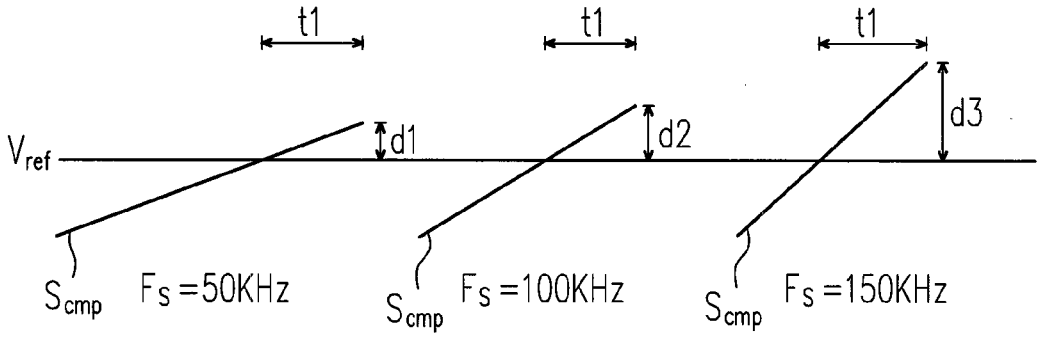
FIGS. 3A-3C are schematic diagrams of a reference voltage and a compensation signal varied along with time under different frequencies.

FIGS. 3A-3C are schematic diagrams of a reference voltage and a compensation signal varied along with time under different frequencies, where t1 is a time required for signal transmission within a general chip, i.e. a delay time from when the current abnormity is detected by the chip to a time point when the switch is indeed turned off. Referring to FIG. 3A, as described above, when the current $I_{led}$ flowing through the LED string 110 is increased to cause the compensation signal $S_{cmp}$ to be higher than the reference voltage $V_{ref}$, the switch Q1 is turned off to avoid continuous increasing of the current $I_{led}$ flowing through the LED string 110. However, as shown in FIG. 3A, since the signal transmission requires the fixed time t1, when the switch Q1 is indeed turned off, the compensation signal $S_{cmp}$ actually has exceeded the reference voltage $V_{ref}$ by an amount d1. For simplicity's sake, the current peak corresponding to an operating frequency $F_s$=50 KHz is set as $I_{peak1}$.

It should be noticed that since a duty cycle of the LED string 110 is $D=V_{led}/V_{in}$, where $V_{led}$ is the cross-voltage of the LED string 110, and the operating frequency of the LED string 110 is $F_s=D/T_{on}=(1-D)/T_{off}$, the operating frequency of the LED string 110 is liable to be influenced by the input power $V_{in}$ and the cross-voltage $V_{led}$ to change the current peak $I_{peak}$. In detail, as shown in FIG. 3B, in case that the delay time t1 is fixed, when the operating frequency $F_s$ of the LED string 110 is increased from 50 KHz to 100 KHz (i.e. a slope of the compensation signal $S_{cmp}$ is increased), since the signal transmission still requires the fixed time t1, in case that the lighting apparatus 100 does not have the compensation unit 126, when the switch Q1 is indeed turned off, the compensation signal $S_{cmp}$ actually has exceeded the reference voltage $V_{ref}$ by an amount d2, and d2>d1. In this way, the current peak of the LED string 110 is increased from $I_{peak1}$ to t $I_{peak2}$, where $I_{peak2}$ is a current peak corresponding to the operating frequency Fs=100 KHz. Similarly, when the operating frequency $F_s$ of the LED string 110 is increased from 100 KHz to 150 KHz (i.e. the slope of the compensation signal $S_{cmp}$ is further increased), since the signal transmission still requires the fixed time t1, when the switch Q1 is indeed turned off, the compensation signal $S_{cmp}$ actually has exceeded the reference voltage $V_{ref}$ by an amount d3, and d3>d2. In this way, the current peak of the LED string 110 is increased from $I_{peak2}$ to $I_{peak3}$, where $I_{peak3}$ is a current peak corresponding to the operating frequency $F_s$=150 KHz. According to the above descriptions, it is know that once the operating frequency $F_s$ is varied along with the variation of the input power $V_{in}$ or the cross-voltage $V_{led}$, the current peak $I_{peak}$ of the LED string 110 is accordingly varied (i.e. increased from $I_{peak1}$ to $I_{peak2}$ or increased from $I_{peak2}$ to $I_{peak3}$), and the average $I_{av}$ of the current $I_{led}$ flowing through the LED string 110 cannot be marinated at the fixed value.

Figures 4A, 4B, 4C:
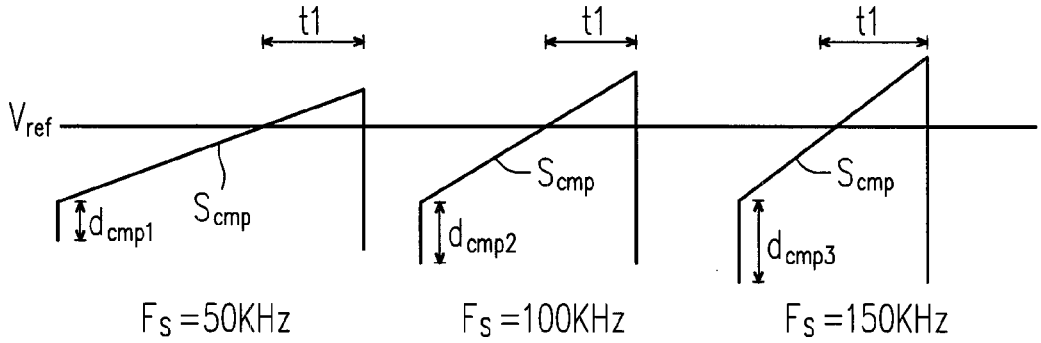
FIGS. 4A-4C are schematic diagrams of a reference voltage and a compensation signal of FIG. 1 varied along with time under different frequencies.

Therefore, in the present embodiment, the compensation unit 126 of the constant current driving circuit 100 is used to resolve the above problem. FIGS. 4A-4B are schematic diagrams of a reference voltage and a compensation signal of FIG. 1 varied along with time under different frequencies. Referring to FIG. 1, in the present embodiment, the compensation resistor $R_{cmp}$ of the compensation unit 126 is coupled between the LED string 110 and the input terminal IP1 of the control unit 122. Since the voltage of the node N1 is $(V_{in}-V_{led})$, a voltage of a node N2 can be represented as $(V_{in}-V_{led})\times R1/(R1+R_{cmp})$ (i.e. the compensation signal $S_{cmp}$), where a resistance of the resistor R1 is, for example, smaller than or equal to 10 ohms, and a resistance of the compensation resistor $R_{cmp}$ is, for example, from 10 ohms to half a million ohms. Therefore, as shown in FIG. 4A and FIG. 4B, once the difference of the input power $V_{in}$ and the cross-voltage $V_{led}$ of the LED string 110 is increased (for example, the input power $V_{in}$ is increased or the cross-voltage $V_{led}$ is decreased), the duty cycle D of the LED 110 is decreased, so that when the operating frequency $F_s$ is increased from 100 KHz to 150 KHz, the voltage of the node N2 (i.e. the compensation signal $S_{cmp}$) is increased as the difference increases. In this way, even if the operating frequency $F_s$ is increased to increase the slope of the compensation signal $S_{cmp}$, since the compensation signal $S_{cmp}$ is directly proportional to the above difference, a higher compensation value $d_{cmp3}$ is provided ($d_{cmp3}>d_{cmp2}$). Therefore, compared to FIG. 4B, the compensation signal $S_{cmp}$ of FIG. 4C exceeds the reference voltage $V_{ref}$ in advance, so as to turn off the switch Q1 in advance. In this way, continuous increasing of the current $I_{led}$ of the LED string 110 is avoided, and the current peaks of FIG. 4C and FIG. 4B are substantially maintained at about the same magnitude (i.e. $I_{peak3}\approx I_{peak2}$), so as to ensure the current flowing through the LED string 10 to be a constant current (i.e. the current average $I_{av}$ of FIG. 2 is substantially maintained at a fixed value). In other words, in the constant current driving circuit 120 of the present embodiment, the compensation signal $S_{cmp}$ provided by the compensation unit 126 can be automatically adjusted along with variation of the operating frequency of the LED string 110, so that the problem of large variation of the current peaks of FIG. 3B and FIG. 3C is avoided.

On the other hand, once the difference of the input power $V_{in}$ and the cross-voltage $V_{led}$ of the LED string 110 is decreased (for example, the input power $V_{in}$ is decreased or the cross-voltage $V_{led}$ is increased), the duty cycle D of the LED 110 is increased, so that when the operating frequency $F_s$ is decreased from 100 KHz to 50 KHz, the voltage of the node N2 (i.e. the compensation signal $S_{cmp}$) is decreased as the difference decreases. In this way, even if the operating frequency $F_s$ is decreased to decrease the slope of the compensation signal $S_{cmp}$, since the compensation signal $S_{cmp}$ is directly proportional to the above difference, a lower compensation value $d_{cmp1}$ is provided ($d_{cmp1}<d_{cmp2}$). Therefore, compared to FIG. 4B, the compensation signal $S_{cmp}$ of FIG. 4A exceeds the reference voltage $V_{ref}$ later, so as to turn off the switch Q1 later. In this way, the current peaks of FIG. 4C and FIG. 4B are substantially maintained at about the same magnitude (i.e. $I_{peak1}\approx I_{peak2}$), so as to ensure the current flowing through the LED string 10 to be a constant current (i.e. the current average $I_{av}$ of FIG. 2 is substantially maintained at a fixed value). In other words, in the constant current driving circuit 120 of the present embodiment, the compensation signal $S_{cmp}$ provided by the compensation unit 126 can be automatically adjusted along with variation of the operating frequency of the LED string 110, so that the problem of large variation of the current peaks of FIG. 3A and FIG. 3B is avoided.

Moreover, besides changing the operating frequency to influence the peak current, the variation of the cross-voltage $V_{led}$ of the LED string 110 further influences the average of the current $I_{led}$. As described above, the average of the current $I_{led}$ can be represented as $I_{av}=I_{peak}-(V_{led}\times T_{off}/2\ L)$, so that when $I_{peak}$ and $T_{off}$ and L are maintained fixed and the cross-voltage $V_{led}$ is decreased, the current average $I_{av}$ is increased accordingly, and when the cross-voltage $V_{led}$ is increased, the current average $I_{av}$ is decreased. Referring to FIG. 1, since the voltage of the node N2 can be represented as $(V_{in}-V_{led})\times R1/(R1+R_{cmp})$ (i.e. the compensation signal $S_{cmp}$), shown as FIG. 4A and FIG. 4B, once the cross-voltage $V_{led}$ is decreased (i.e. the difference of $(V_{in}-V_{led})$ is increased), the voltage of the node N2 (i.e. the compensation signal $S_{cmp}$) is also increased as the difference increases. In this way, even if the current average $I_{av}$ is increased theoretically, since the compensation signal $S_{cmp}$ is directly proportional to the difference, a higher compensation value $d_{cmp2}$ ($d_{cmp2}>d_{cmp1}$) is provided, so that compared to FIG. 4A, the compensation signal $S_{cmp}$ of FIG. 4B exceeds the reference voltage $V_{ref}$ in advance to turn off the switch Q1 in advance. Therefore, continuous increasing of the current of the LED string 110 is avoided, and the averages of the currents of FIG. 4B and FIG. 4A are substantially maintained to about the same magnitude (i.e. $I_{av2}\approx I_{av1}$), so as to ensure the current flowing through the LED string 10 to be a constant current. When the cross-voltage $V_{led}$ is increased (i.e. the difference of $(V_{in}-V_{led})$ is decreased), the operation principle thereof can be deduced according to the above descriptions, and details thereof are not repeated.

According to the above descriptions, since the compensation signal $S_{cmp}$ is directly proportional to the difference ($V_{in}-V_{led}$), and the operating frequency of the LED string 110 is correlated with the input power $V_{in}$ and the cross-voltage $V_{led}$, when the cross-voltage $V_{led}$ is varied or the operating frequency $F_s$ is varied as the input power $V_{in}$ and the cross-voltage $V_{led}$ are varied, the compensation signal $S_{cmp}$ can be correspondingly adjusted to control the magnitude of the current peak $I_{peak}$, so as to achieve the effect of driving the LED string 110 by a constant current. In other words, the current peak $I_{peak}$ of the embodiment is less influenced by the delay time or the variation of the operating frequency variation or the variation of the cross-voltage $V_{led}$, so that the lighting apparatus 100 can provide the LED light source with stable brightness.

Second Embodiment

Figure 5:
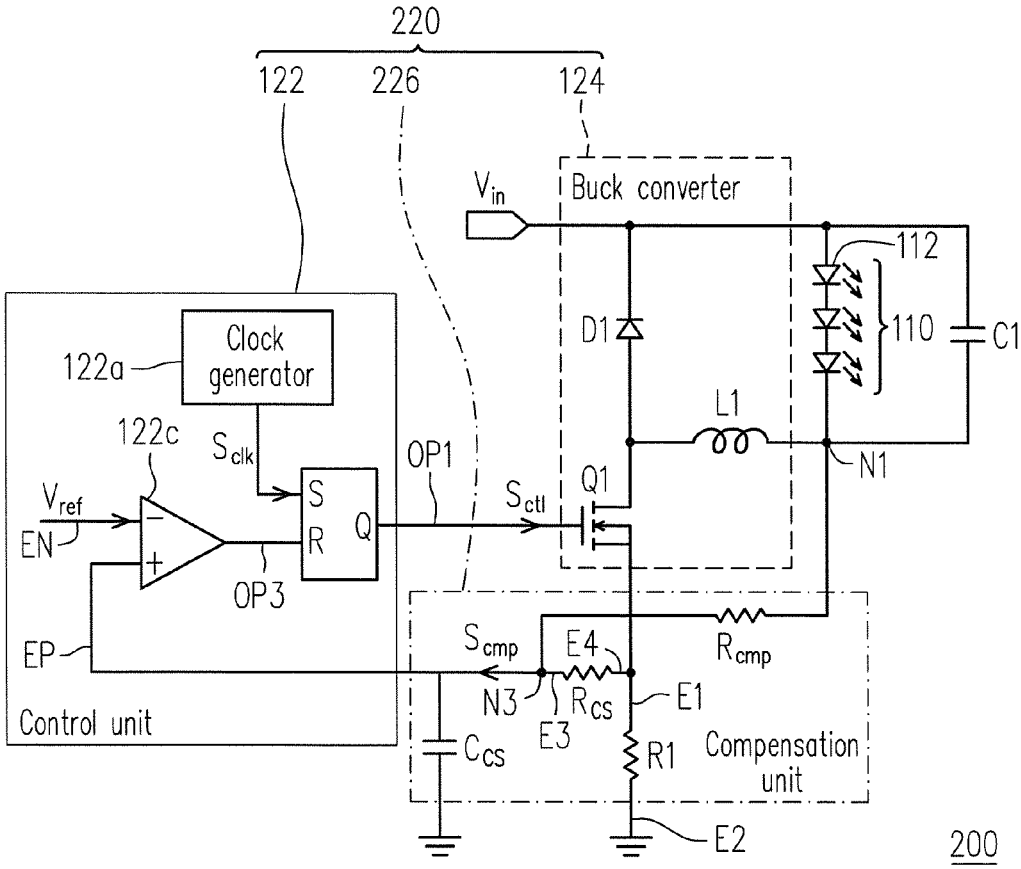
FIG. 5 is a schematic diagram of a lighting apparatus according to the second embodiment of the invention.

FIG. 5 is a schematic diagram of a lighting apparatus according to the second embodiment of the invention. The lighting apparatus 200 is similar to the lighting apparatus 100 of FIG. 1, and a main difference there between is that a compensation unit 226 of the present embodiment further includes a filter resistor $R_{cs}$ and a filter capacitor $C_{cs}$, where the filter resistor $R_{cs}$ is coupled between the compensation resistor $R_{cmp}$ and the resistor R1, and the filter capacitor $C_{cs}$ is coupled between the filter resistor $R_{cs}$ and the ground. The filter resistor $R_{cs}$ and the filter capacitor $C_{cs}$ are used for filtering a voltage of a node N3 (i.e. the compensation signal $S_{cmp}$), so as to reduce the ripple of the compensation signal $S_{cmp}$.

In the present embodiment, the voltage of the node N3 can be represented as $(V_{in}-V_{led})\times(R1+R_{cs})/(R1+R_{cmp}+R_{cs})$ (i.e. the compensation signal $S_{cmp}$), where $V_{in}$ is the input power, $V_{led}$ is the cross-voltage of the LED string 110. Moreover, a resistance of the resistor R1 is smaller than or equal to 10 ohms, a resistance of the compensation resistor $R_{cmp}$ is, for example, from 10,000 ohms to 90 million ohms, and a resistance of the filter resistor $R_{cs}$ is, for example, 1,000 ohms to 2,000 ohms. Similarly, since the compensation signal $S_{cmp}$ is correlated with the cross-voltage $V_{led}$, when the cross-voltage $V_{led}$ is varied, the compensation signal $S_{cmp}$ is correspondingly adjusted to control a magnitude of the current peak $I_{peak}$, so as to achieve the effect of driving the LED string 110 by the constant current. Besides, since the compensation signal $S_{cmp}$ is directly proportional to the difference ($V_{in}-V_{led}$), and the operating frequency of the LED string 110 is correlated with the input power $V_{in}$ and the cross-voltage $V_{led}$, when the operating frequency $F_s$ is varied as the input power $V_{in}$ and the cross-voltage $V_{led}$ are varied, the compensation signal $S_{cmp}$ can be correspondingly adjusted to control the magnitude of the current peak $I_{peak}$, so as to achieve the effect of driving the LED string 110 by the constant current. In other words, the current peak $I_{peak}$ of the embodiment is less influenced by the variation of the cross-voltage $V_{led}$ or the delay time or the variation of the operating frequency variation, so that the lighting apparatus 200 can provide the LED light source with stable brightness. Since related operation principles of the lighting apparatus 200 of the present embodiment and the current driving circuit 220 are similar to that of the first embodiment, details thereof are not repeated.

However, it should be noticed that in other embodiments, the lighting apparatus 200 may include the filter resistor $R_{cs}$ or the filter capacitor $C_{cs}$ only, and the invention is not limited to the embodiment of FIG. 5. Moreover, as shown in FIG. 5, the lighting apparatus 200 further includes a capacitor C1. The capacitor C1 is coupled to two ends of the LED string 110 to filter the current of the LED string 110.

In summary, in the embodiments of the invention, since the compensation signal provided by the compensation unit is directly proportional to the difference of the input power and the cross-voltage of the LED string, when the cross-voltage of the LED string is varied or the operating frequency of the LED string is varied as the input power or the cross-voltage is varied, the compensation signal can be correspondingly adjusted to control the peak current of the current flowing through the LED string, so as to achieve the effect of driving the LED string by the constant current. Therefore, the lighting apparatus can provide the LED light source with stable brightness.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A constant current driving circuit of a light emitting diode (LED), comprising:

a control unit, having a first input terminal and a first output terminal, and outputting a control signal through the first output terminal;

a buck converter, coupled to an input power, and coupled between the first output terminal of the control unit and an LED string; and a compensation unit, directly coupled between the LED string and the first input terminal of the control unit, wherein the control unit receives a compensation signal of the compensation unit through the first input terminal, wherein the compensation unit comprises:

a compensation resistor, coupled between the LED string and the first input terminal of the control unit;

a first resistor, having a first end coupled to the compensation resistor and a second end directly coupled to ground; and a filter resistor, having a third end directly coupled to the compensation resistor and a fourth end directly coupled to the first end of the first resistor.

2. The constant current driving circuit of the LED as claimed in claim 1, wherein the LED string is coupled between a first end and a second end of the buck converter.

3. The constant current driving circuit of the LED as claimed in claim 2, wherein the compensation unit has a second input terminal and a second output terminal, the second input terminal is coupled to the second end of the buck converter, and the second output terminal is coupled to the first input terminal of the control unit.

4. The constant current driving circuit of the LED as claimed in claim 1, wherein a resistance of the compensation resistor is from 10 ohms to half a million ohms.

5. The constant current driving circuit of the LED as claimed in claim 1, wherein a resistance of the compensation resistor is from 10,000 ohms to 90 million ohms.

6. The constant current driving circuit of the LED as claimed in claim 1, wherein the compensation unit further comprises a filter capacitor coupled between the filter resistor and the ground.

7. The constant current driving circuit of the LED as claimed in claim 1, further comprising a capacitor coupled to two ends of the LED string.

8. The constant current driving circuit of the LED as claimed in claim 1, wherein the buck converter comprises:

a diode, coupled to the input power and the LED string;

an inductor, coupled between the diode and the LED string, wherein the LED string, the inductor and the diode form a loop; and a switch, having one end coupled to the diode and the inductor, and another end coupled to the compensation unit.

9. The constant current driving circuit of the LED as claimed in claim 1, wherein the control unit comprises:

a clock generator;

an SR flip-flop, coupled between the clock generator and the buck converter, having a set terminal and a reset terminal, and receiving a clock signal through the set terminal; and a comparator, having a positive terminal, a negative terminal and a third output terminal, wherein the positive terminal is coupled to the compensation unit, the negative terminal receives a reference voltage, and the third output terminal is coupled to the reset terminal of the SR flip-flop.

10. A lighting apparatus, comprising:

a light emitting diode (LED) string; and a constant current driving circuit, coupled to the LED string, and comprising:

a control unit, having a first input terminal and a first output terminal, and outputting a control signal through the first output terminal;

a buck converter, coupled to an input power, and coupled between the first output terminal of the control unit and the LED string; and a compensation unit, directly coupled between the LED string and the first input terminal of the control unit, wherein the control unit receives a compensation signal of the compensation unit through the first input terminal, wherein the compensation unit comprises:

a compensation resistor, coupled between the LED string and the first input terminal of the control unit;

a first resistor, having a first end coupled to the compensation resistor and a second end directly coupled to ground; and a filter resistor, having a third end directly coupled to the compensation resistor and a fourth end directly coupled to the first end of the first resistor.

11. The lighting apparatus as claimed in claim 10, wherein the LED string is coupled between a first end and a second end of the buck converter.

12. The lighting apparatus as claimed in claim 11, wherein the compensation unit has a second input terminal and a second output terminal, the second input terminal is coupled to the second end of the buck converter, and the second output terminal is coupled to the first input terminal of the control unit.

13. The lighting apparatus as claimed in claim 10, wherein a resistance of the compensation resistor is from 10 ohms to half a million ohms.

14. The lighting apparatus as claimed in claim 10, wherein a resistance of the compensation resistor is from 10,000 ohms to 90 million ohms.

15. The lighting apparatus as claimed in claim 10, wherein the compensation unit further comprises a filter capacitor coupled between the filter resistor and the ground.

16. The lighting apparatus as claimed in claim 10, further comprising a capacitor coupled to two ends of the LED string.

17. The lighting apparatus as claimed in claim 10, wherein the buck converter comprises:

a diode, coupled to the input power and the LED string;

an inductor, coupled between the diode and the LED string, wherein the LED string, the inductor and the diode form a loop; and a switch, having one end coupled to the diode and the inductor, and another end coupled to the compensation unit.

18. The lighting apparatus as claimed in claim 10, wherein the control unit comprises:

a clock generator;

an SR flip-flop, coupled between the clock generator and the buck converter, having a set terminal and a reset terminal, and receiving a clock signal through the set terminal; and a comparator, having a positive terminal, a negative terminal and a third output terminal, wherein the positive terminal is coupled to the compensation unit, the negative terminal receives a reference voltage, and the third output terminal is coupled to the reset terminal of the SR flip-flop.

* * * * *